US008955526B2

(12) United States Patent
Smith

(10) Patent No.: US 8,955,526 B2
(45) **Date of Patent: *Feb. 17, 2015**

(54) HAIR STYLING DEVICE

(71) Applicant: Tyme, LLC, Bellevue, IA (US)

(72) Inventor: Jacynda Smith, Bellevue, IA (US)

(73) Assignee: Tyme LLC, Bellevue, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/206,450

(22) Filed: Mar. 12, 2014

(65) Prior Publication Data

US 2014/0261522 A1 Sep. 18, 2014

Related U.S. Application Data

(60) Provisional application No. 61/802,574, filed on Mar. 16, 2013.

(51) Int. Cl.

| | |
|---|---|
| ***A45D 1/14*** | (2006.01) |
| ***A45D 7/02*** | (2006.01) |
| *A45D 1/04* | (2006.01) |

(52) U.S. Cl.

CPC .. *A45D 1/14* (2013.01); *A45D 7/02* (2013.01); *A45D 1/04* (2013.01)

USPC ..... 132/224

(58) Field of Classification Search

USPC ..... 132/224, 229, 269; 219/225, 227

See application file for complete search history.

(56) References Cited

U.S. PATENT DOCUMENTS

| | | | | |
|---|---|---|---|---|
| 2,776,667 | A * | 1/1957 | Fitz Gerald | 132/224 |
| 6,070,596 | A | 6/2000 | Altamore | |
| D489,482 | S * | 5/2004 | Cho | D28/35 |
| 2009/0032048 | A1 * | 2/2009 | Suzuki et al. | 132/224 |
| 2010/0269848 | A1 * | 10/2010 | Morgandi et al. | 132/269 |
| 2012/0111355 | A1 | 5/2012 | Vacheron et al. | |
| 2012/0211018 | A1 * | 8/2012 | deGrood | 132/211 |
| 2012/0272994 | A1 | 11/2012 | Sayers et al. | |

FOREIGN PATENT DOCUMENTS

| | | | |
|---|---|---|---|
| WO | 2010081968 | A1 | 7/2010 |
| WO | 2014015144 | A1 | 1/2014 |

OTHER PUBLICATIONS

Copenheaver, Blaine R., "International Search Report and Written Opinion re Application No. PCTU/US2014/026330", Jul. 15, 2014, p. 12 Published in: US.

* cited by examiner

*Primary Examiner* — Robyn Doan

(74) *Attorney, Agent, or Firm* — Neugeboren O'Dowd PC

(57) ABSTRACT

A hair styling device comprising a first blade section, a second blade section, and at least one fin. The first blade section comprises an inner blade surface and at least one first blade section heating element one of coupled to and integrated with the inner blade surface. The second blade section may be rotatably coupled to the first blade section and may comprise at least one second blade section heating element substantially opposing the at least one first blade section heating element. The at least one second blade section heating element may also comprise a substantially flat surface and at least one outer surface. A portion of the at least one fin is one of coupled and integrated to the at least one outer surface.

8 Claims, 12 Drawing Sheets

HAIR STYLING DEVICE

PRIORITY

This application claims priority to U.S. Provisional Application No. 61/802,574, filed Mar. 16, 2013 and entitled a "Hair Styling Device, System, and Method," which is incorporated herein by reference in its entirety.

FIELD OF THE INVENTION

The present invention relates to a hair styling device. In particular, but not by way of limitation, the present invention relates to a hair styling device adapted to both straighten and curl hair.

BACKGROUND OF THE INVENTION

Existing straightening and curling hair-styling devices only perform a single function—they either straighten or curl hair. It is expensive and inconvenient to own two types of devices. For example, each device may cost upwards of $100 or more and the space taken up by the two devices is substantial, especially in small bathrooms with minimal storage space. Furthermore, having multiple hair-styling devices creates a cluttered look, even in a professional hair styling booth. Additionally, since many bathrooms and professional hair styling booths only contain a single power outlet, having two devices that require power from a single outlet may create an electrical hazard and may overload an electrical circuit.

SUMMARY OF THE INVENTION

Embodiments of the device disclosed herein are differentiated from prior art devices by curling the hair from about the scalp to about the tips of the hair in a single sliding motion of the device and comprises a single device to both straighten and curl hair.

One embodiment of the inventions comprises a hair styling device comprising a first blade section, a second blade section, and a fin. One first blade section comprises an inner blade surface and at least one first blade section heating element one of coupled to and integrated with at least a portion of inner blade surface. The second blade section may be rotatably coupled to the first blade section and the second blade section may comprise at least one second blade section heating element substantially opposing the at least one first blade section heating element. The at least one second blade section heating element may comprise a substantially flat surface and at least one outer surface. The fin at least one of coupled and integrated to the at least one outer surface.

Another embodiment of the invention comprises a method of styling hair. One such method comprises positioning a first opening of a hair styling device comprising a first heating element and a second heating element in a generally vertical position. A second opening of the hair styling device may be placed in a generally horizontal position, with the second opening comprising a generally perpendicular opening as compared to the first opening. The hair may then be placed in the hair styling device and the hair styling device may be moved along the hair. The first heating element and the second heating element may contact the hair one of before and after the hair travels through the second opening, at which point one of straightening and curling the hair occurs.

Yet another embodiment of the invention comprises a hair straightening/curling device. One such device comprises a casing, at least one pair of substantially opposing heating elements coupled to the casing, and at least one fin at least one of coupled and integrated to the casing.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings wherein:

DETAILED DESCRIPTION

Figure 1:
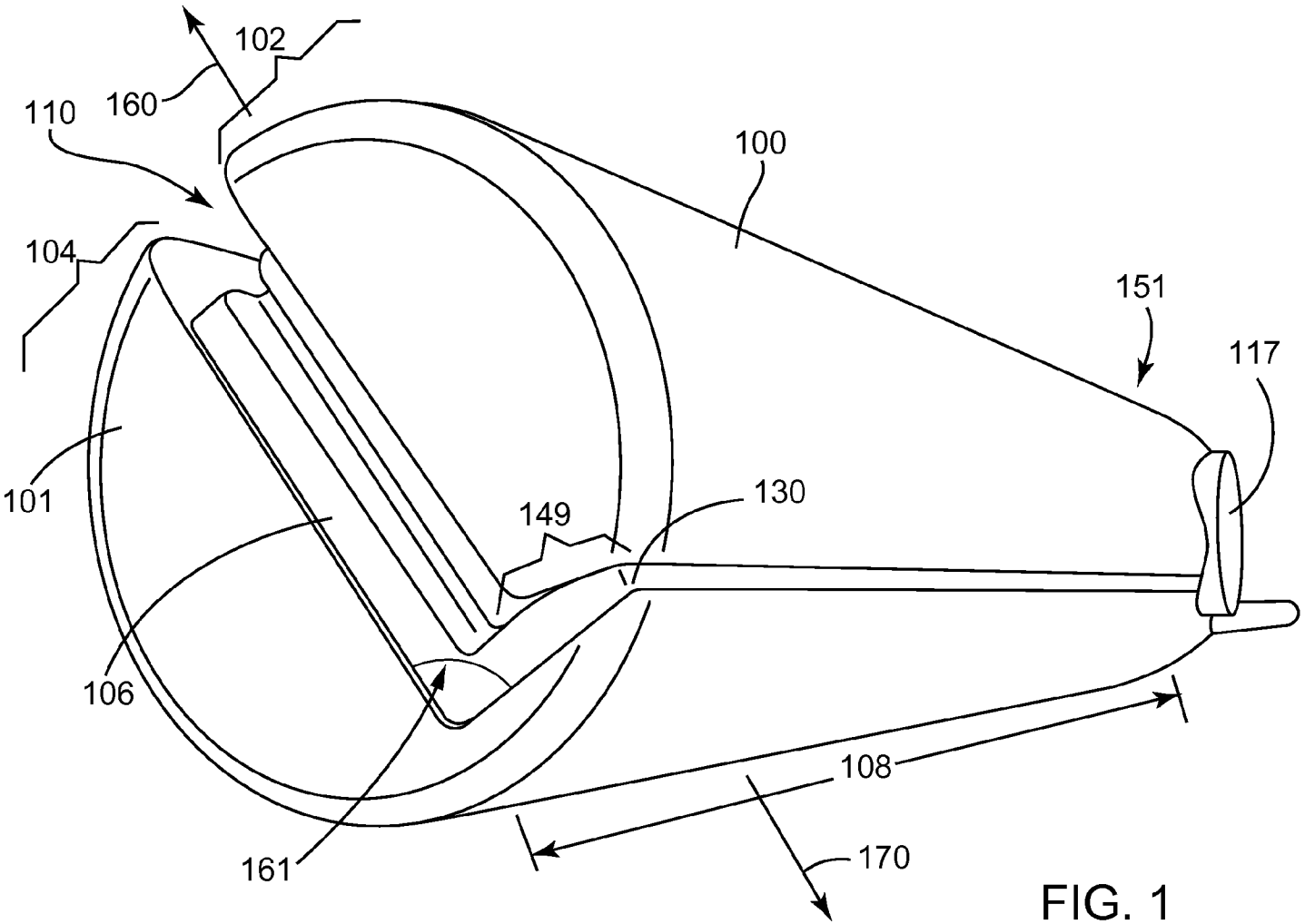
FIG. 1 depicts a skewed front view of a device in a first position according to one embodiment of the invention.
Figure 5:
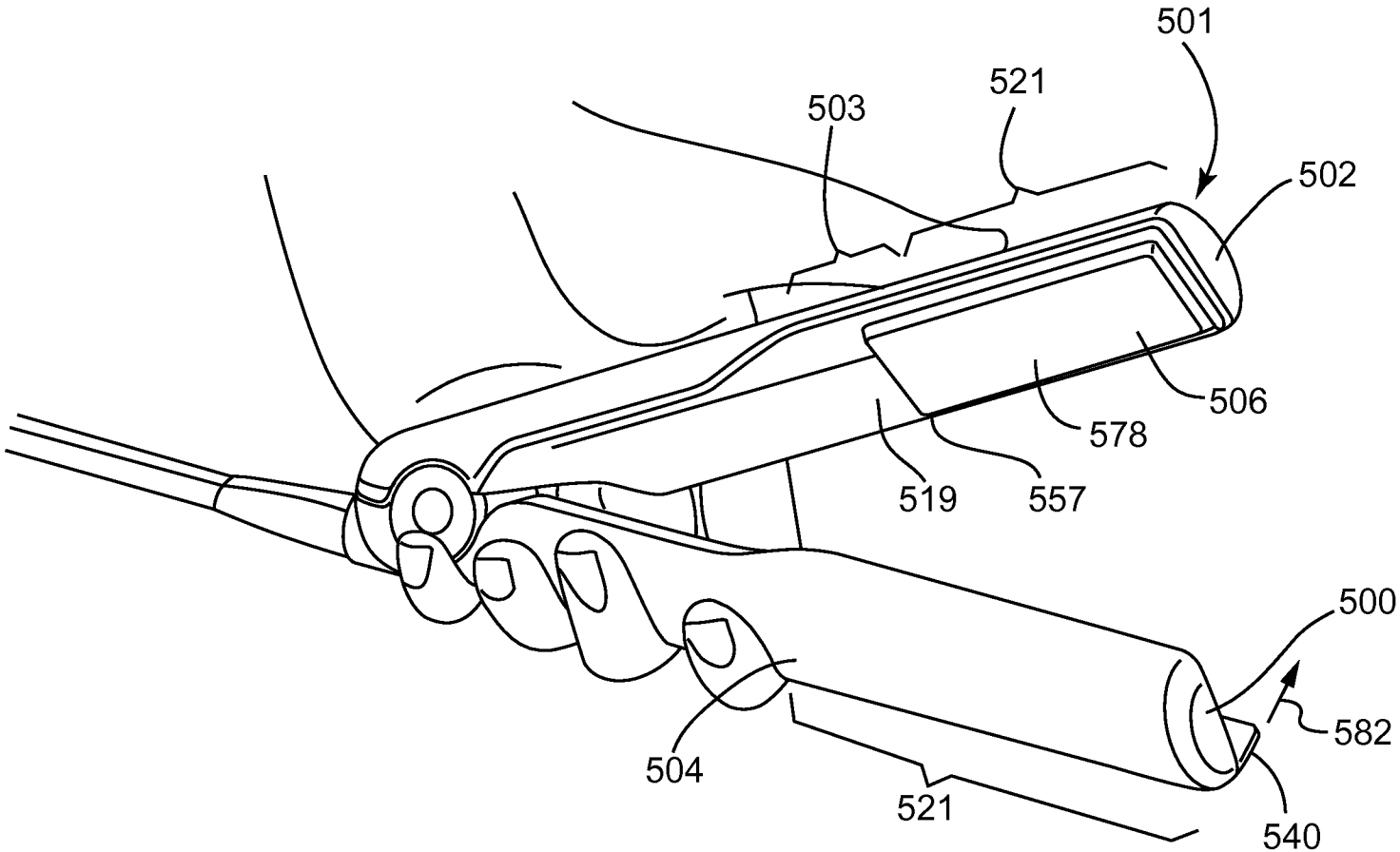
FIG. 5 depicts an isometric view of a device in an open position according to one embodiment of the invention.

Turning first to FIG. 1, seen is one embodiment of a hair styling device 100 in a closed position. One closed position may comprise a first device position. One hair styling device 100 comprises a first blade section 102 and a second blade section 104. Each of the first blade section 102 and the second blade section 104 may comprise a heating element 106, which may also be referred to herein as a heating element pair. One such heating element pair 506 runs about half the length 108 of the device, from a proximal device end 501 to a center portion 503 of the device 500, as seen the open device position seen in FIG. 5. The device 100 may also comprise a distal end 151, as seen in FIG. 1. As seen in FIG. 5, the heating element pair 506 may comprise opposing substantially flat surfaces and may be adapted to apply heat to hair. Furthermore, the heating element pair 506 may be one of coupled and integrated to an inner surface 519 of each device section 502, 504. The inner surface 519 may also be referred to herein as an inner blade surface. The portion of the inner blade surface which the heating element pair 506 is coupled to may comprise a first portion 521 and at least part of the inner surface 519 may also comprise a substantially flat surface. One heating element 506 may comprise a heating element distal end 557.

It is contemplated that throughout the application, the term "coupled" or any other similar term may refer to attaching distinctly individual items to one another through a coupling mechanism such as, but not limited to, a nut/bolt system, magnetic coupling mechanism, or any other system known in the art. The term "integrate" or any other similar term may refer to a single unitary embodiment, where appropriate.

Figure 8A:
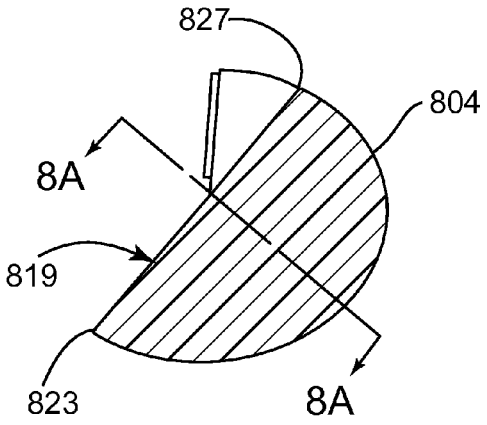
FIG. 8A depicts a cross-sectional view of a device along line 8A-8A in FIG. 9 according to one embodiment of the invention.
Figure 8B:
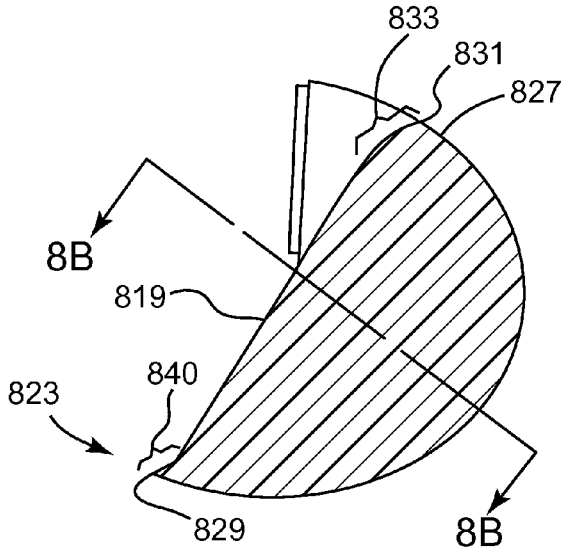
FIG. 8B depicts a cross-sectional view of a device along line 8B-8B in FIG. 9 according to one embodiment of the invention.
Figure 8C:
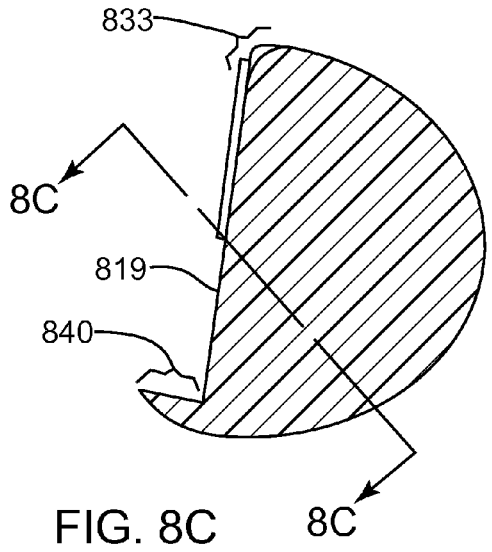
FIG. 8C depicts a cross-sectional view of a device along line 8C-8C in FIG. 9 according to one embodiment of the invention.
Figure 8D:
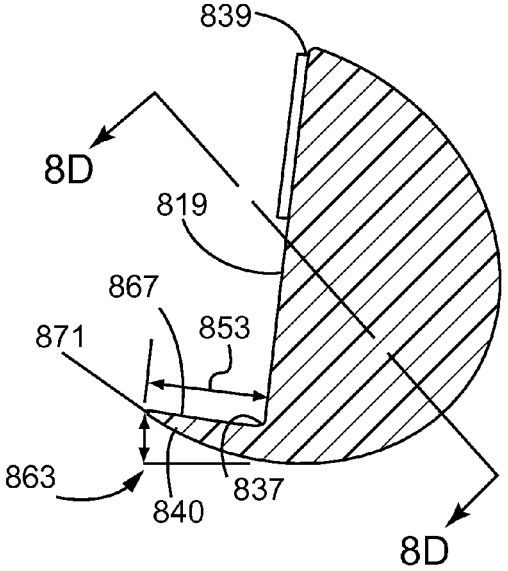
FIG. 8D depicts a cross-sectional view of a device along line 8D-8D in FIG. 9 according to one embodiment of the invention.
Figure 9:
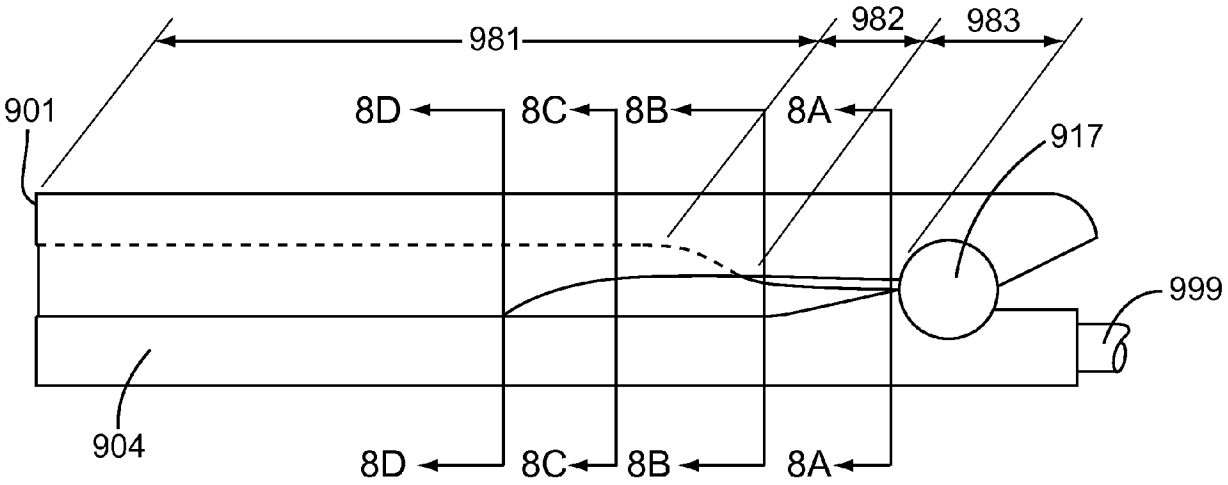
FIG. 9 depicts a side view of a device according to one embodiment of the invention.

Turning now to FIGS. 8A-8D, seen are cross-sectional views taken of the second blade section 904 at varying locations seen in FIG. 9. For example, FIG. 8A shows the cross-sectional view of line 8A-8A in FIG. 9, located proximal the pivoting device 917. As seen in FIG. 8A, the inner blade surface 819 of the second blade section 804 along line 8A-8A is a substantially flat inner blade surface extending from a first outer surface location 823 to a second outer surface location 827. At least a portion of the first blade section 802 may comprise a correspondingly similar inner blade surface 819 and outer blade surface 877 as those shown in FIGS. 8A-8D. Turning now to FIG. 8B, seen is a cross-sectional view of line 8B-8B of FIG. 9. As seen, instead of extending from the first outer surface location 823 of FIG. 8A the inner blade surface 819 along line 8B-8B in FIG. 9 extends from a third outer surface location 829. The third outer surface location 829 is located counter-clockwise circumferentially as compared to the first outer surface location 823 in FIG. 8A. Additionally, a tip of a device fin 840 may be formed at cross-section 8B-8B. Furthermore, the second outer surface location 827 has changed relative to FIG. 8A to the fourth outer surface location 831, with the fourth outer surface location 831 being located at a counter-clockwise circumferential distance from the second outer surface location 827. There may also be a curve 833 in the inner blade surface 819 near the fourth outer surface location 831. As seen in FIG. 8C, along cross-sectional line 8C-8C in FIG. 9, the device fin 840 is larger and there is a smaller curve 833 in the inner blade surface 819, while at section 8D-8D, the full length 853 and size of the fin 840 is present and the inner surface 819 extends from an inner fin base 837 to a fifth outer blade surface 839 in a substantially flat manner. A similar cross-sectional view as the view seen along line 8D-8D may also be found to about the proximal device end 901 in one embodiment.

Figure 2:
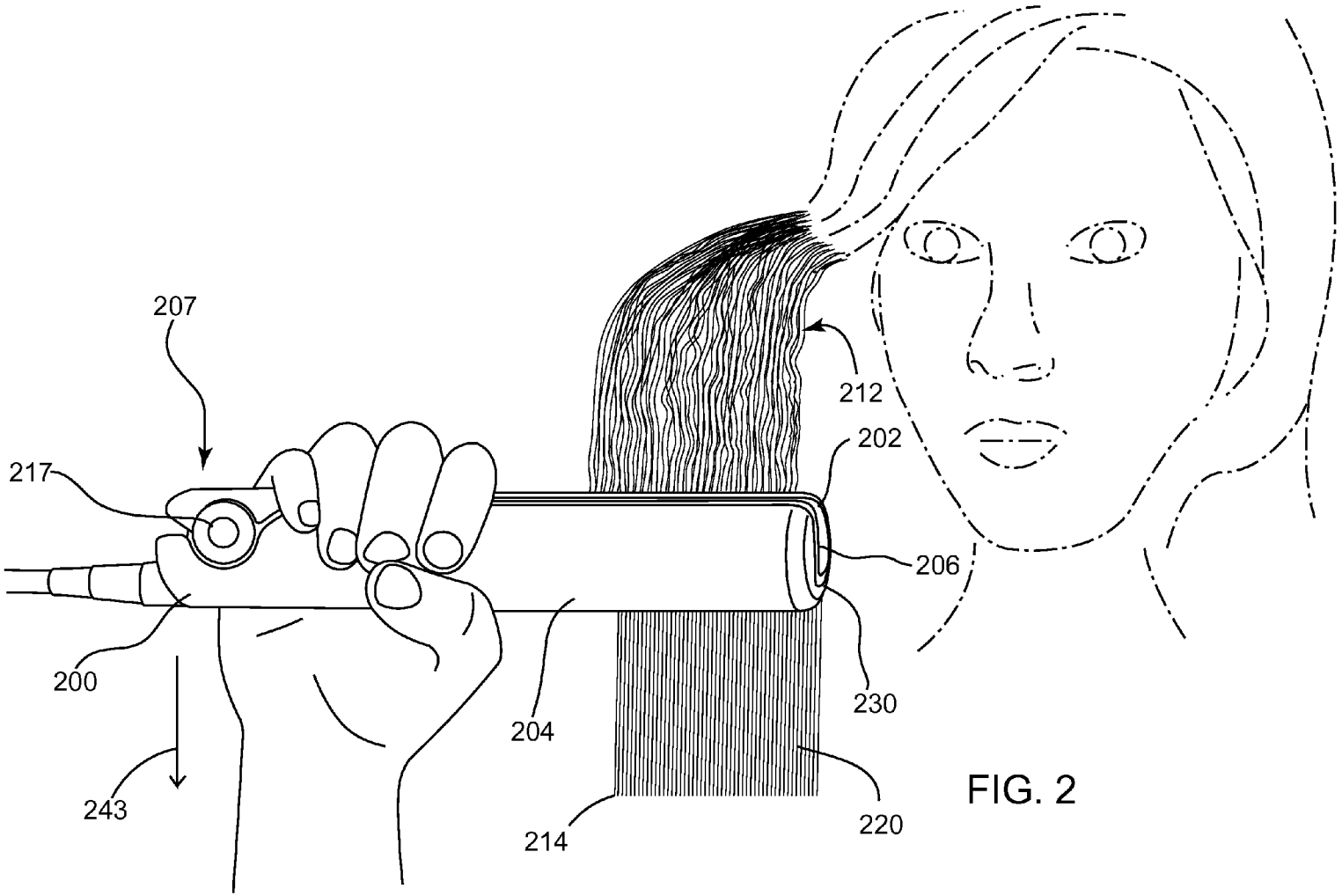
FIG. 2 depicts one method of straightening hair that may be carried out with the embodiments described herein.

Returning now to FIG. 1, one device 100 may be used to straighten curly hair and to curl straight hair by sliding hair through the device 100 from about the base of the hair at or near the scalp to the end of the hair at or near the tips, or wherever the sliding motion begins and ends along the length of the hair. Seen in FIG. 2 is one embodiment of the device 200 being used with a first method to straighten hair 220. In order to implement the FIG. 2 method to straighten hair, and as seen in FIGS. 7A-7D, a user may first change the device 700 from the substantially closed position seen in FIG. 7A to an of the first, second or third open positions seen in FIGS. 7B-7D, respectively, in order to place hair between the heating elements 506, as seen in FIG. 5. In moving the device 700 from the substantially closed position seen in FIG. 7A to one of the open positions seen in FIGS. 7B-7D, the first blade section 702 and/or the second blade section 704 may pivot about a distal device end 251, using a pivoting device 217 as seen in FIG. 2.

Figure 7A:
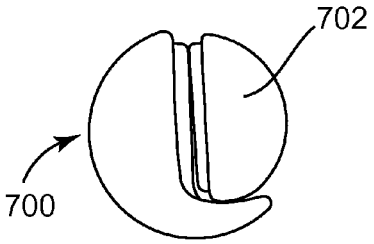
FIG. 7A depicts a proximal end view of a closed device according to one embodiment of the invention.
Figure 7B:
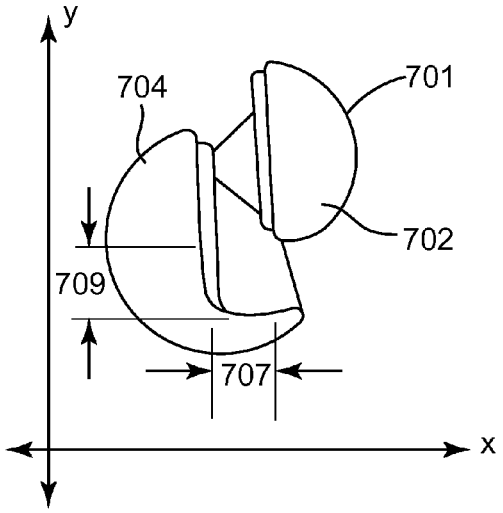
FIG. 7B depicts a proximal end view of a device in a first open position according to one embodiment of the invention.
Figure 7C:
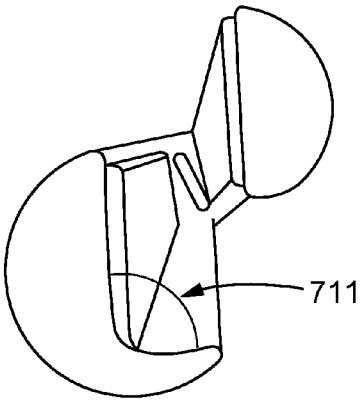
FIG. 7C depicts a proximal end view of a device in a second open position according to one embodiment of the invention.

As seen in the first open device position of FIG. 7B, the proximal end 701 of the device 700 may be aligned to an x-y co-ordinate system. In opening the device 700, the first blade section 704 and the second blade section 702 may be separated by a first x-distance 707 and a first y-distance 709 at the proximal end 701. The angle 711 at which the two sections separate, as seen in the second open device position of FIG. 7C may be determined by the angle 713 which the pivoting device 717 is one of coupled and integrated to at least one of the first blade section 702 and the second blade section 704, as seen in the third open device position of FIG. 7D. For example, the angle 713 may be the angle at which the distal end 251 rotates relative to an extension surface 747. One extension surface 747 may comprise an inner surface on fin 740 and may be substantially perpendicular to an outer surface of the heating element 706 on the second blade section 704. One heating element outer surface 569 may be seen in FIG. 5, with the FIG. 5 heating element outer surface 569 comprising a first section 502 heating element 506. It is also contemplated that at least one of the one or more fin dimensions (length, thickness, etc.) and the angle 711, 713 may affect one or more curl features such as, but not limited to size, shape, direction, fullness, etc.

Figure 7D:
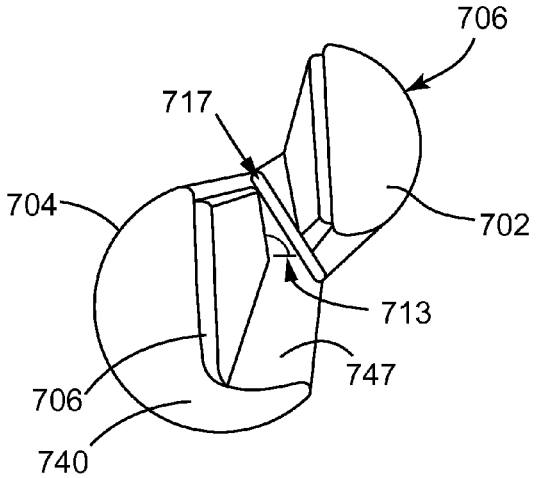
FIG. 7D depicts a proximal end view of a device in a third open position according to one embodiment of the invention.

Upon opening the device 700 to, for example, the position seen in FIG. 7D, a person's hair such as, but not limited to the hair 220 seen in FIG. 2 may be placed between the first blade section 202 and the second blade section 204 and the device 200 may be returned to the closed position seen in FIG. 7A. In one method, the device 200 may be placed at or near a first end 212 of the hair 220, wherein the first end 212 of the hair 220 comprises a hair end proximal a person's head or scalp. The hair may extend away from the person's head and through the first opening 110 of the device, as seen in FIG. 1. The hair may then extend between the heating element pair 106 and exit the device 100 through a second opening 130. Returning now to FIG. 2, upon placing the hair 220 in the device 200 in such a manner, the device 200 may then be pulled away from the person's head and towards a second end 214 of the hair. One second end of the hair comprise and end of the hair 220 distal a person's head. In one embodiment, the first opening 210 may be placed in a vertically upward position, as seen in FIG. 2

Moving the hair 220 through the device 200 in such a manner—first between the heating elements 206 and then proximal the inner surface 867 of the fin 840 as seen in FIG. 8D may straighten a person's hair—thereby changing hair from curly or wavy hair to substantially or generally straight hair. As seen in FIG. 1, as the hair travels next to the fin 140, the hair may be pressed against the fin by an outer portion 149 of the first blade section 102. Straightening the hair 220 with the device 200 is performed by applying heat to the hair 220 prior to the device fin 140 contacts the hair 220. As seen in FIG. 1, the fin 140 may be integrated to an outer surface 177 of the second blade section 104 and extends substantially perpendicularly away from the second bade section heating element 106. However, other angles are also contemplated.

Figure 3:
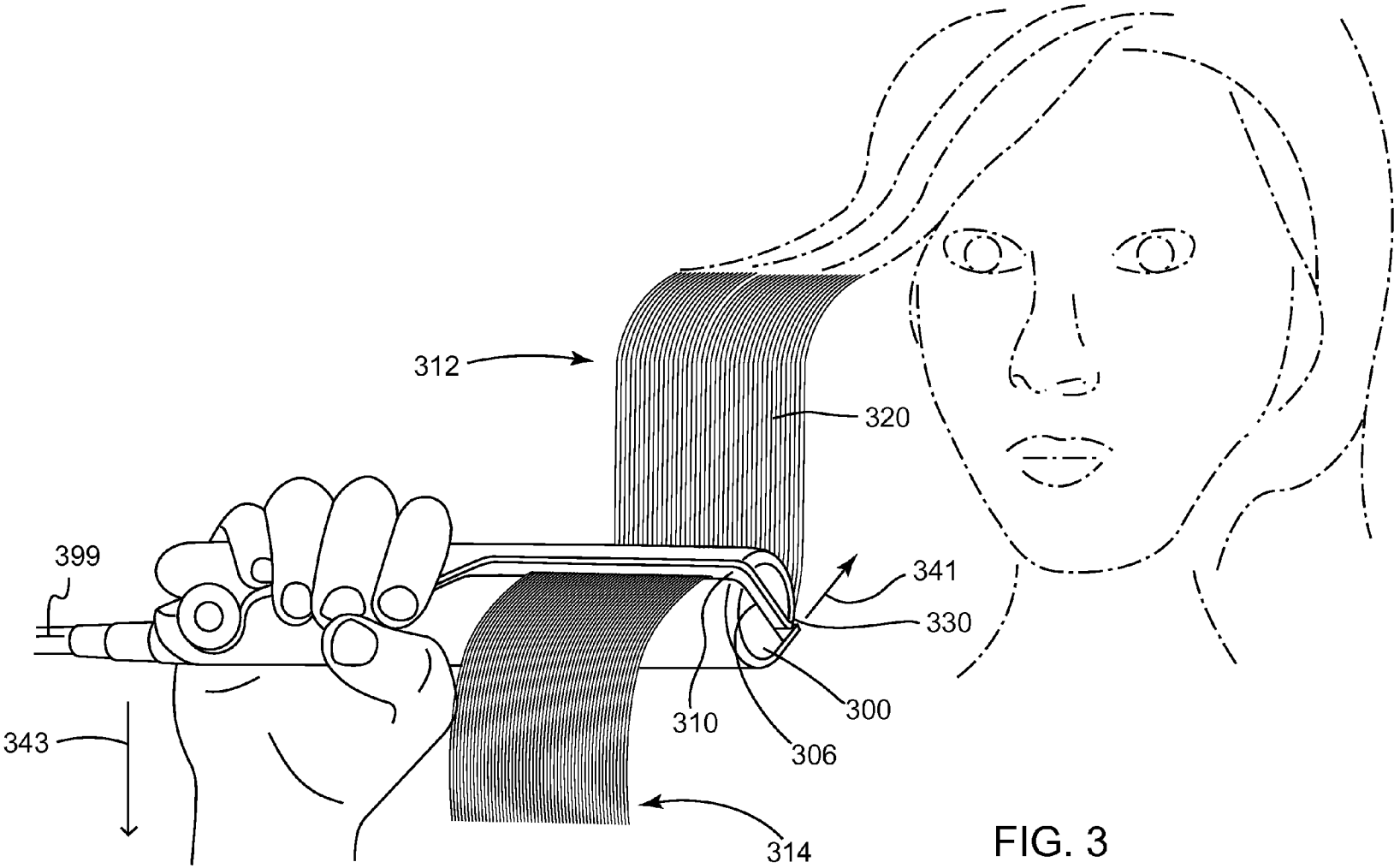
FIG. 3 depicts one method of curling hair that may be carried out with the embodiments described herein.

Turning now to FIG. 3, seen is an example of curling hair in a first direction, wherein one first direction comprises curling hair in a direction towards a person—where the curls open towards a person's head. Similar to the FIG. 2 method of straightening a person's hair with the device 200, in the FIG. 3 method of curling a person's hair 320 with the device 300, the device 300 may first couple to the hair at or near the first end 312 of the hair. However, in contrast to the straightening method of FIG. 2, the hair may enter the device 300 through the second opening 130 seen in FIG. 1, extending between the heating element pair, and exit the device 100 through the first opening 110 with the first opening 110 facing the person, as seen by the first arrow 341 in FIG. 3. Upon placing the hair 320 in the device 300 in such a manner, the device may then be pulled away from the person's head and towards the second end 314 of the hair 320 in the direction seen by the second arrow 343. Pulling the device 300 away from the head moves the hair 320 through the device 300, which may curl a person's hair—thereby changing hair from substantially or generally straight hair to substantially or generally curly or wavy hair. Curling the hair 320 with the device 300 is performed by applying heat to the hair 320 after the hair 320 enters the second opening 330 and contacts the device fin 140, as seen in FIG. 1.

Figure 4A:
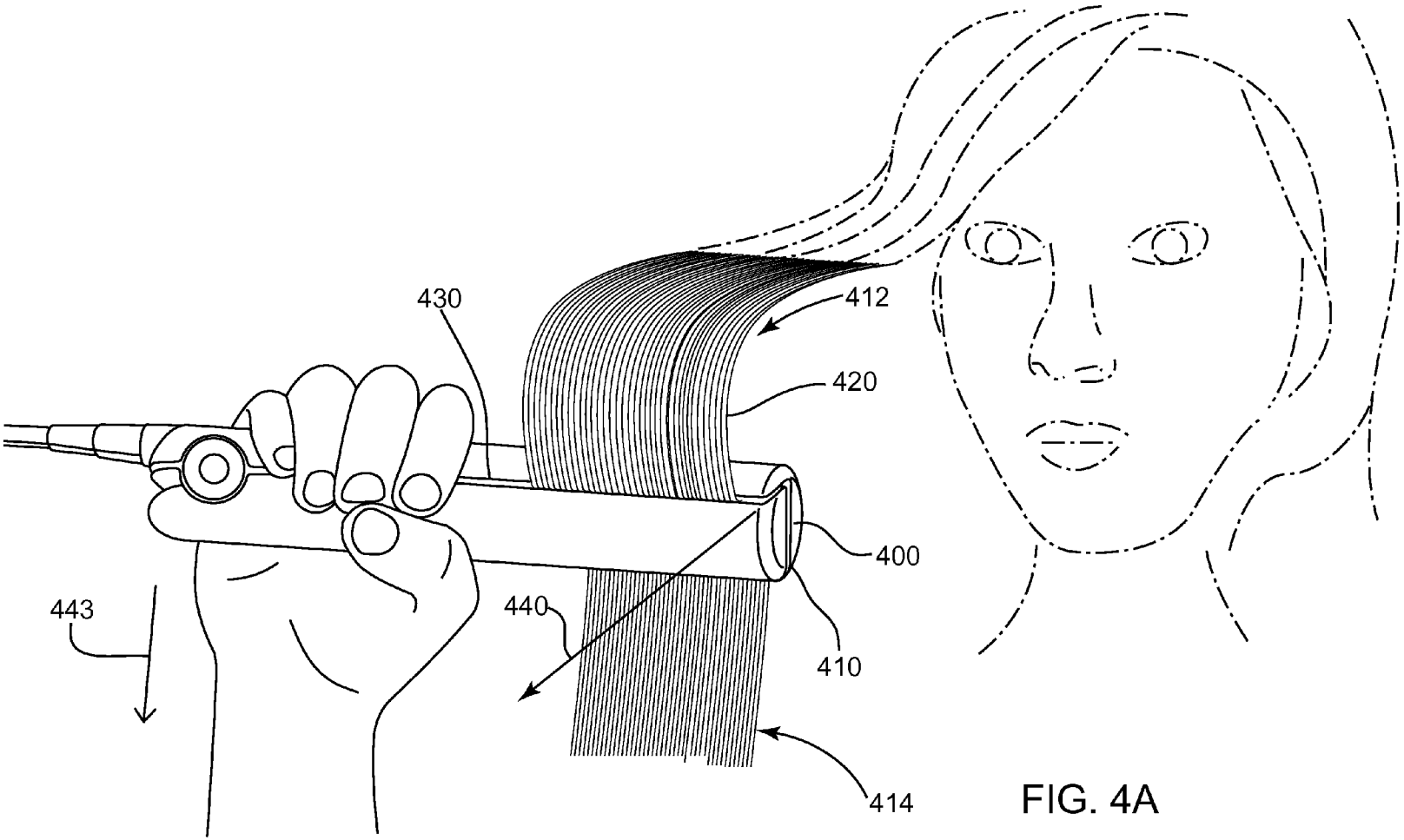
FIG. 4A depicts one method of curling hair that may be carried out with the embodiments described herein.
Figure 4B:
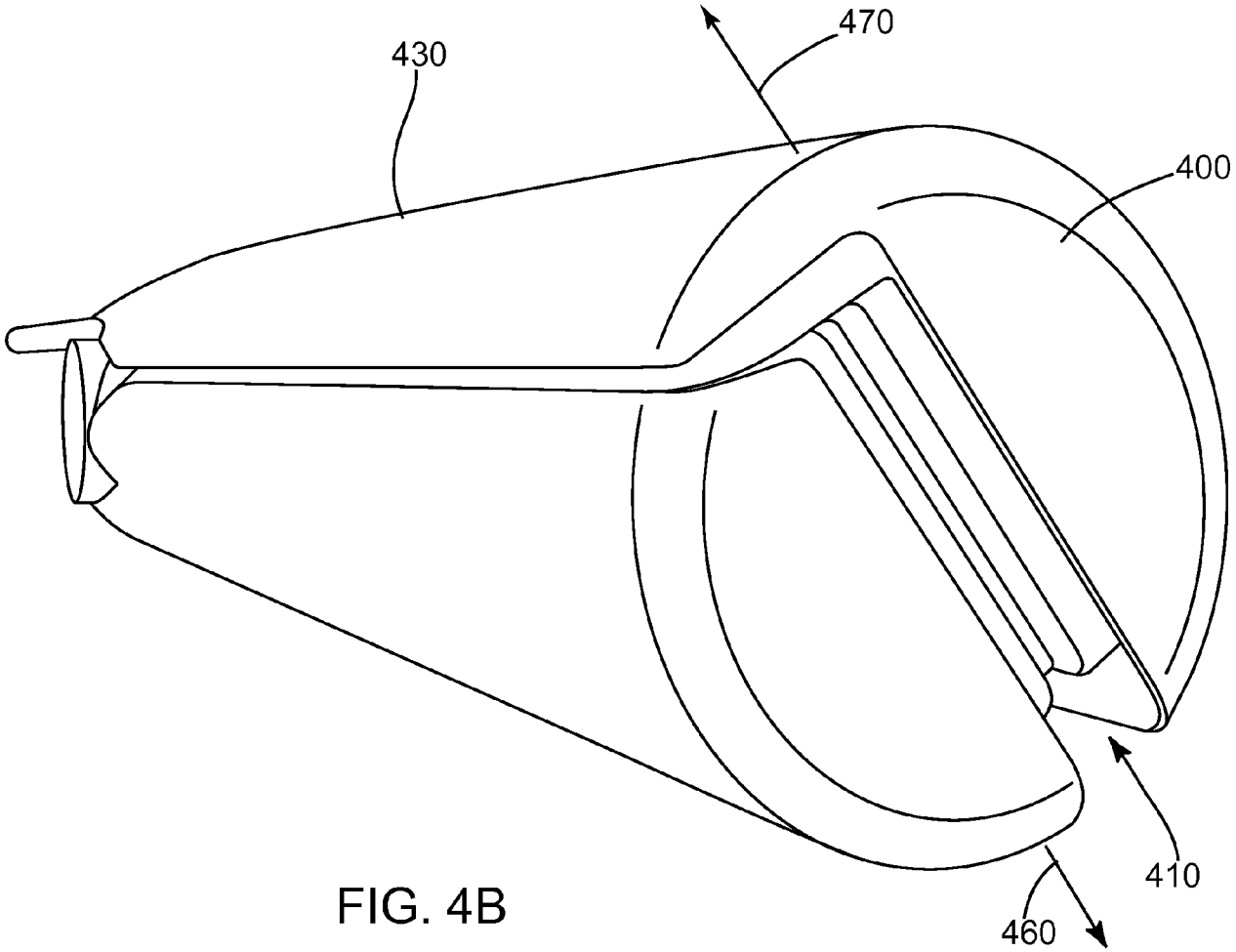
FIG. 4B depicts a skewed front view of a device in a second position according to one embodiment of the invention.
Figure 12:
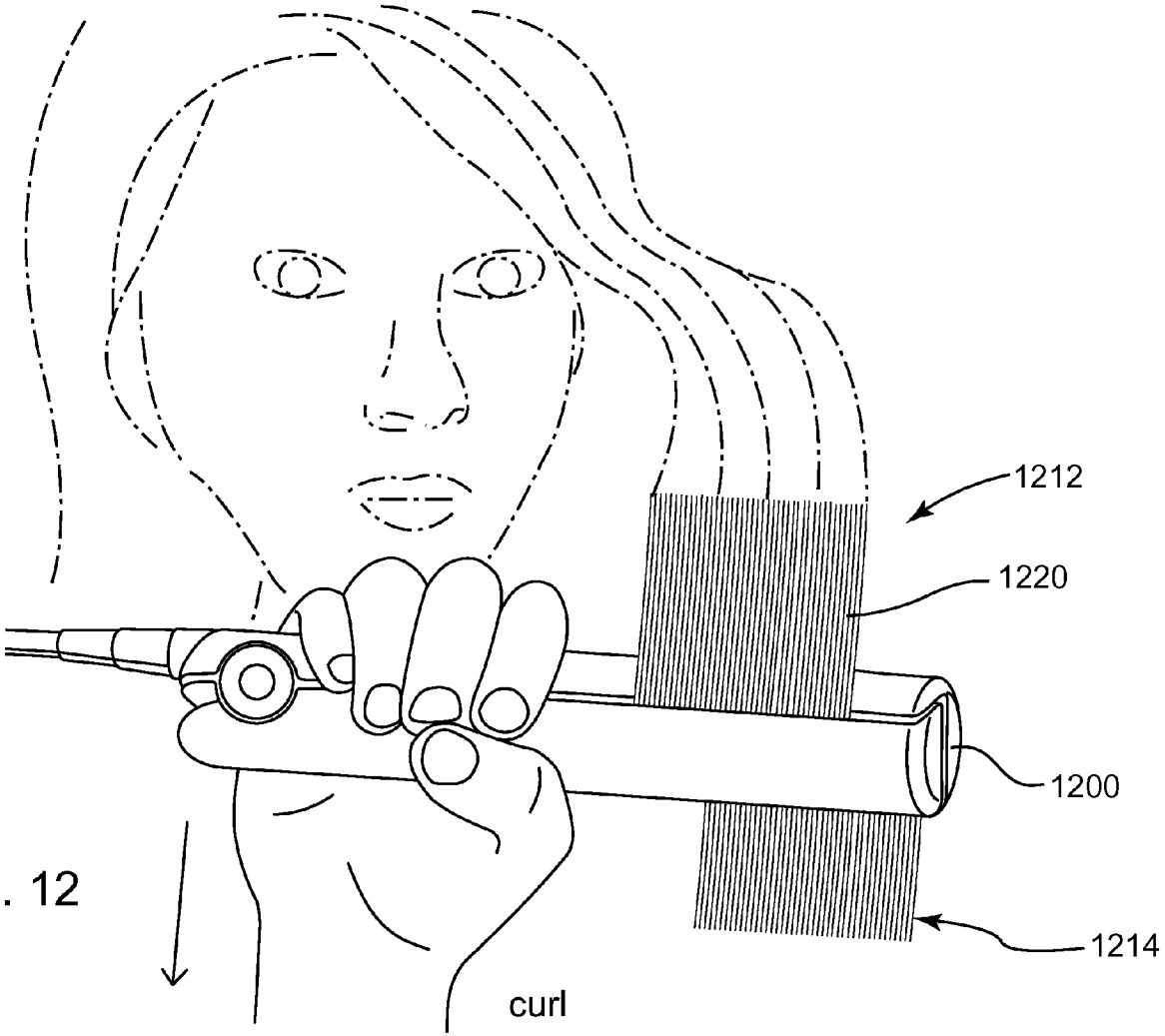
FIG. 12 depicts one method of curling hair that may be carried out with the embodiments described herein.

Turning now to FIGS. 4A and 12, seen is an example of curling hair 420, 1220 in a second direction, wherein one second direction comprises creating hair curls where the curls fall away or open away from a person's head. Similar to the FIG. 3 method of curing a person's hair with the device 300, in the FIGS. 4A and 12 method of curling a person's hair 420, 1220 with the device 400, 1200, the hair 420, 1220 to be curled may be placed in the device 400, 1200 between the heating elements 106 seen in FIG. 1, at or near the first end 412, 1212 of the hair. Further similar to the curling method of FIG. 3, the hair 420, 1220 may enter the device 400, 1200 through the second opening 430 seen in FIG. 4B, extending between the heating element pair, and exit the device 400 through the first opening 410. The second opening 430 may be facing away from the person in FIGS. 4A and 12, as seen by the first arrow 441, 1221. Therefore, the direction of the second opening 430, 1230 in the FIGS. 4A and 12 method may oppose the direction of the second opening 330 in the FIG. 3 method. In one embodiment, the direction of the curl may be dependent upon the direction of the second opening 430, 330, 1230. For example, in the FIGS. 4A and 12 method, the second opening 430, 1230 may open away from a person and creates curls in a similar direction, which opposes the direction of the curls with the FIG. 3 method—towards the person. Therefore, it is contemplated that additional curl directions beyond towards a person and away from a person as seen in FIGS. 3, 4A, and 12, respectively, are contemplated. In FIGS. 4A and 12, upon placing the hair 420, 1220 in the device 400, 1200 in such a manner, the device 400, 1200 may then be pulled away from the first end 412, 1212 of the hair and towards the second end 414, 1214 of the hair 400, 1200 in the direction shown by the second arrow 443, 1243, thereby sliding the hair through the openings 410, 1210 and 430, 1230. FIG. 4B comprises a close-up of the placement of the device 400 when the FIGS. 4A and 12 method are undertaken. The position of the device seen in FIG. 4B may comprise a second device position.

Turning now to FIG. 5, seen is one embodiment of the device 500 in an open position, as opposed to the closed position seen in FIGS. 1-4B. In order to open the device, in one embodiment, at least one of the first blade section 502 may rotatably slide generally in a first direction 160, 460, and/or the second blade section 504 may rotatable slide generally in a second direction 170, 470 as seen in FIGS. 1 and 4B. Upon reaching the open position, a person's hair 220, 320, 420 may be placed in the device between the heating elements 506 and at least one of the first blade section 502 and second blade section 504 may rotate in a third direction and fourth direction substantially opposing the first direction 160, 460 and second direction 170, 470 seen in FIGS. 1 and 4, thereby returning the device 100, 400 to the closed position, at which point the methods described with reference to FIGS. 2-4B may be implemented to straighten and/or curl the hair 220, 320, 420. It is also contemplated that the first blade section 502 and/or the second blade section 504 may open in one or more non-rotatable manners known in the art such as, but not limited to, a clasping manner.

Figure 6:
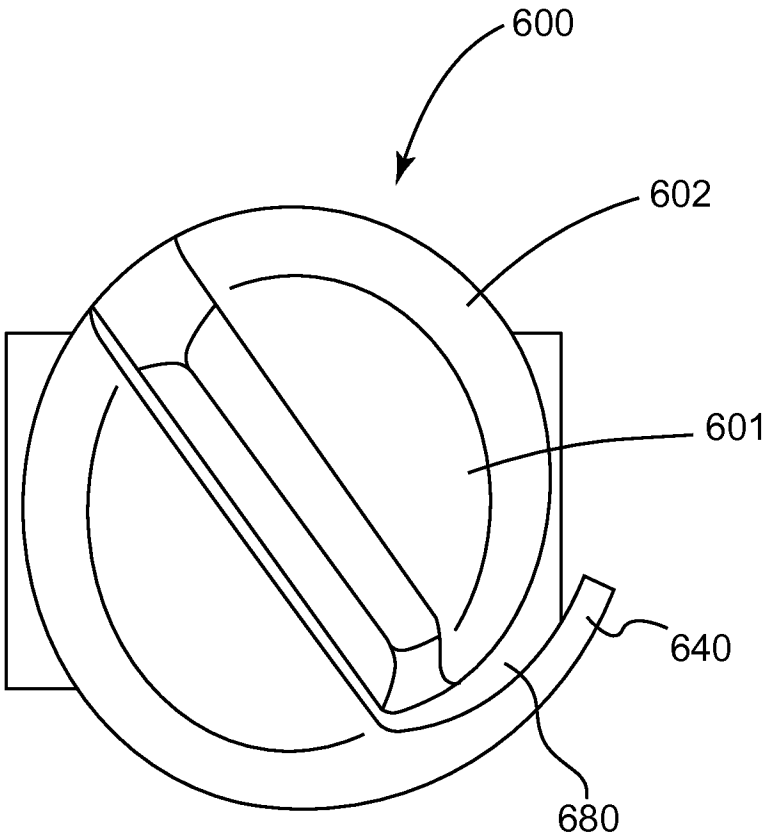
FIG. 6 depicts a proximal end view of a device according to one embodiment of the invention.

Turning now to FIG. 6, seen is an end view of one embodiment of a device 600. For example, FIG. 6 is a representation of the device as seen from looking at the proximal end 101, 601 of the device 100, 600, as seen in FIGS. 1 and 6. As seen in FIG. 6, the device 600 may comprise a space 680 between the fin 640 and the first section 602, although the size of the space 680 may be greater than or less than the space 680 seen in FIG. 6.

Figure 11:
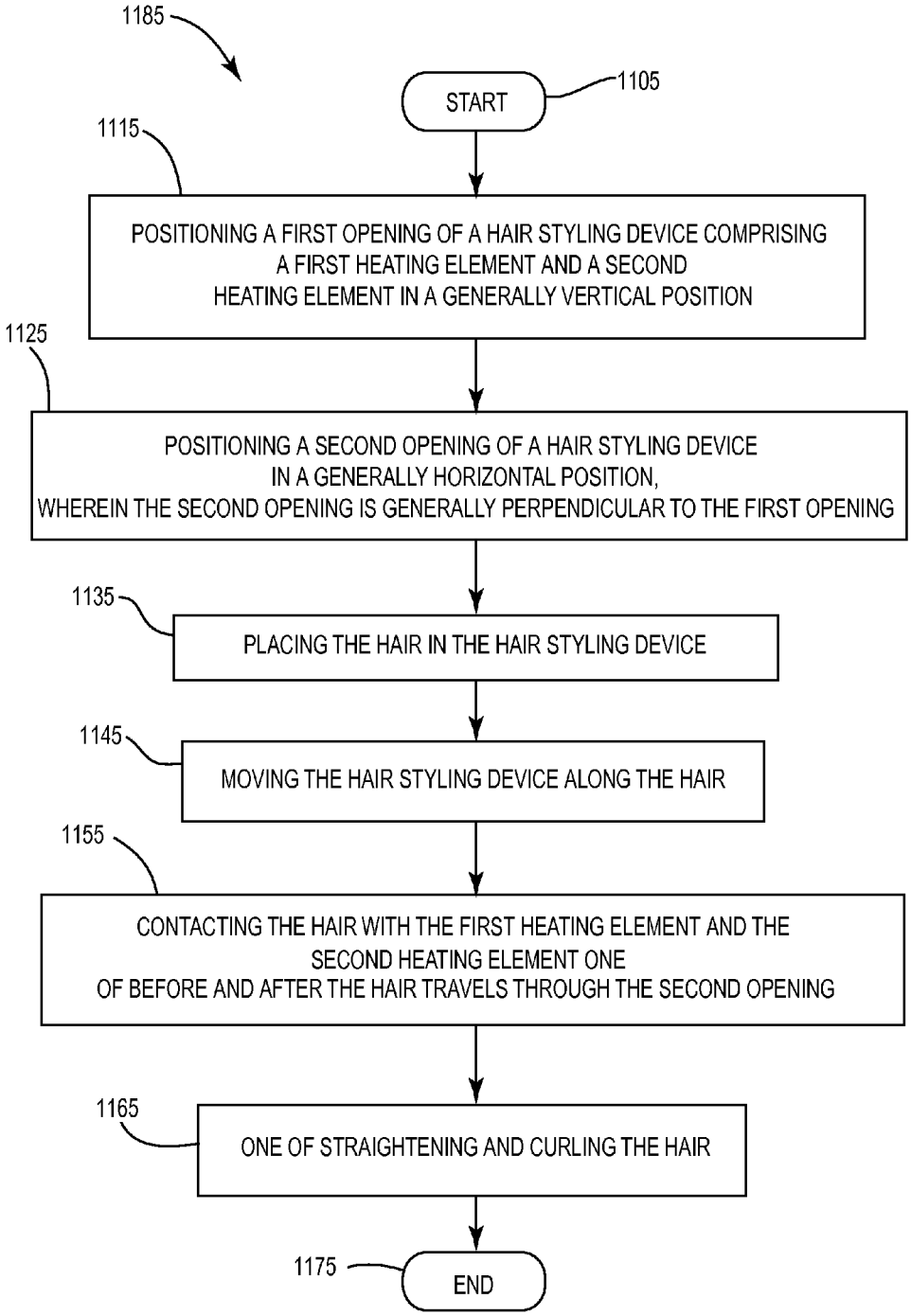
FIG. 11 depicts a method of straightening hair that may be carried out with the embodiments described herein.

Turning now to FIG. 11, seen is a method 1185 of styling hair. The method starts at 1105 and at 1115 comprises positioning a first opening of a hair styling device in a generally vertical position. Such a hair styling device may comprise the device 100 seen in FIG. 1 and described herein. Such a vertical position may comprise a position where the first opening 110 generally faces upward or downward. At 1125, the method 1185 comprises positioning a second opening of a hair styling device in a generally horizontal position, wherein the second opening is generally perpendicular to the first opening. For example, the second opening 140 may generally towards or away from a user of the device, depending on whether the first opening 110 is upwardly facing or downwardly facing. At step 1135, a person's hair may then be placed in the device, similar to the images seen in FIGS. 2-4A. At step 1145, the method 1185 comprises moving the hair styling device along the hair. For example, the arrows 242, 343, 443 seen in FIGS. 2-4A show a direction the device may be moved along the hair after coupling the device to the hair between the heating elements. At step 1155, the method 1185 comprises contacting the hair with the first heating element and the second heating element one of before and after the hair travels through the second opening. For example, as seen in FIG. 3, the hair 320 contacts the heating elements 306 after traveling through the second opening 330 as the device 300 is pulled in the direction shown by the arrow 343, whereas in FIG. 2, the hair 220 contacts the heating elements 206 before traveling through the second opening 230 as the device 200 is pulled in the direction shown by the arrow 243. At step 1165, the method 1185 comprises one of straightening and curling the hair. The method 1185 ends at 1175. In one embodiment, contacting the hair with the first heating element and the second heating element before the hair travels through the second opening, as seen in FIG. 2 may enable the device to straighten the hair.

One method 1185 may further comprise additional steps. One such step may comprise pivotably separating the first heating element and the second heating element prior to placing the hair in the hair styling device. For example, a first blade section 102 may rotatably slide in the first direction 160 about the pivoting device 117 while the second blade section 104 may rotatably slide in the second direction 170 about the pivoting device 117. One device 110 may also rotate in only one of the first direction 160 and second direction 170.

In another method 1185, positioning the first opening 310 in a generally vertical position may comprise positioning the first opening 110 in a generally upward vertical position, as seen in FIG. 3. Furthermore, positioning a second opening 330 in a generally horizontal position may comprise positioning the second opening 330 towards the person's head, as also seen in FIG. 3. The curls created with such a configuration may comprise curls opening towards the person's head. Through multiple applications of such a method, a plurality of curls may be created in the hair 320, with each of the curls opening towards the person's head.

As seen in FIG. 1, it is further contemplated that the first opening 110 and the second opening 130 are separated by an angle 161 and the second opening may comprise an opening proximal a device fin 140 having a length 853 and a width 863, as seen in FIG. 8D. The fin 840 may also comprise one or more shapes. For example, in FIG. 8D, the fin 840 comprises a substantially flat inner surface 867 and a generally rounded outer surface 862 meeting at a point 871. However, each of these features may comprise different shapes or dimensions. Regardless, it is contemplated that at least one of one or more fin dimensions and the angle 161 may affect the curl dimensions, size, shape, and any other curl feature. Similarly, positioning a first opening 110 in a generally downward vertical position and positioning a second opening 130 generally away from the person's head, as seen in FIG. 4A may comprise creating curls in the hair that open away from the person's head.

Figure 10:
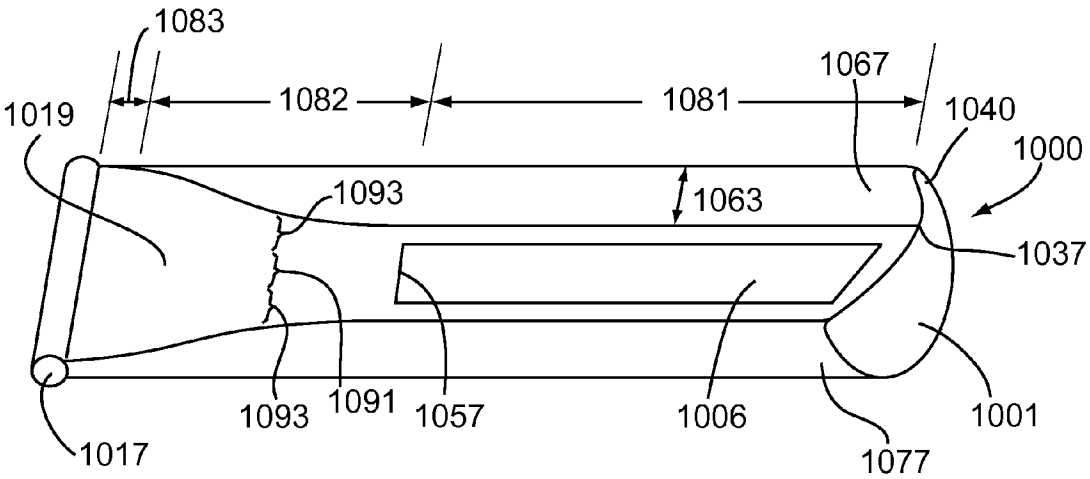
FIG. 10 depicts a skewed side view of a second blade section according to one embodiment of the invention.

Turing now to FIG. 10, seen is a hair styling device 1000 with an inner blade surface 1067 having a first inner blade surface portion 1083, a second inner blade surface portion 1082, and a third inner blade surface portion 1081. Each of the first inner blade surface portion 1083, second inner blade surface portion 1082, and third inner blade surface portion 1081 correspond to the first inner blade surface portion 983, second inner blade surface portion 982, and third inner blade surface portion 981, respectively, as seen in FIG. 9. As seen in FIG. 10, the length 1053 of the fin 1040 length at the first inner blade surface portion 1083 comprises a zero length, the fin length 1053 at the second inner blade surface portion 1082 comprises a varying length, and the fin length 1053 at the third inner blade portion 1081 comprises a substantially stable length 1053. It is further contemplated that the first portion 1083 of the inner blade surface 1019 comprises a substantially flat surface starting from about the pivoting device. The inner blade surface 1019 in the second portion 1082 comprises a substantially flat portion 1091 and at least one substantially rounded portion 1093, with the FIG. 10 second portion 1082 having two rounded portion 1093. The inner blade surface 1019 at the third portion 1081 comprises a substantially flat portion extending from the inner fin base 1037 to the outer blade surface 1077. Also seen in FIG. 9 is a power cord 999 adapted to receive electricity from, for example, a wall power outlet. The power cord 999 is electronically coupled to the heating elements 506, as seen in FIG. 5. The device 500 may be adapted to use the electricity to heat the heating elements to a desired temperature. The power cord 399 is also shown in FIG. 3.

The device 100 seen in FIG. 1 and throughout the application may also be referred to herein as a hair straightening/curling device 100. One hair straightening/curling device 100 may comprise a casing. One casing may comprise the outer blade surface 1077 and may comprise a gripping device. For example, the casing may be adapted to receive a person's hand, as shown in FIGS. 3-5 and 12. Additionally, each of the first blade section 102 and second blade section 104 may comprise an outer blade surface 1077. Furthermore, the straightening/curling device 100 may also comprise at least one pair of substantially opposing heating elements 106 that are one of coupled and integrated to the casing. Although one only one heating element 506 is shown in FIG. 5, for example, such a heating element 506 may comprise a plurality of heating elements 506. The hair straightening/curling device 100 also comprises at least one fin 140, with the fin being coupled and/or integrated to the casing. Although the devices shows and described herein all comprise a single fin 140, multiple fins 140 are also contemplated.

The at least one pair of substantially opposing heating elements 106 may comprises substantially opposing heating element surfaces such as, but not limited to, the heating element surface 578 see in FIG. 5. Furthermore, the at least one fin 540 may comprise a first length having a first length direction 582, with the first length direction being substantially perpendicular to at least one of the substantially opposing heating element surfaces 578. The first length direction is substantially perpendicular to a first of the substantially opposing heating element surfaces in a first direction and the first length direction is substantially perpendicular to a second of the substantially opposing heating element surface in a second direction, wherein the second direction substantially opposes the first direction. The hair straightening/curling device is adapted for use in a first method to straighten hair, the hair straightening/curling device is adapted for use in a second method to curl hair in a first direction, and the hair straightening/curling device is adapted for use in a third method to curl hair in a second direction.

Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. A method of styling hair comprising, positioning a first opening of a hair styling device in a generally vertical position, wherein the hair styling device comprises a first heating element and a second heating element;

positioning a second opening of the hair styling device in a generally horizontal position, wherein the second opening is separated from the first opening by an angle;

placing the hair in the hair styling device;

moving the hair styling device along the hair;

contacting the hair with the first heating element and the second heating element one of before and after the hair travels through the second opening; and one of straightening and curling the hair.

2. The method of claim 1 further comprising, pivotably separating the first heating element and the second heating element prior to placing the hair in the hair styling device.

3. The method of claim 2 wherein, pivotably separating the first heating element and the second heating element comprises bi-directionally separating the first heating element from the second heating element.

4. The method of claim 1 wherein, contacting the hair with the first heating element and the second heating element one of before and after the hair travelling through the second opening comprises contacting the hair with the first heating element and the second heating element before the hair travels through the second opening; and one of straightening and curling the hair comprises straightening the hair.

5. The method of claim 1 wherein, the hair comprises hair growing from a person's head;

positioning a first opening of a hair styling device comprising a first heating element and a second heating element in a generally vertical position comprises positioning the first opening of a hair styling device in a generally upward vertical position;

positioning a second opening of a hair styling device in a generally horizontal position comprises positioning the second opening of a hair styling device generally towards the person's head;

contacting the hair with the first heating element and the second heating element one of before and after the hair travelling through the second opening comprises contacting the hair with the first heating element and the second heating element after the hair travels through the second opening; and one of straightening and curling the hair comprises creating curls in the hair, wherein the curls generally open in the direction of the second opening.

6. The method of claim 5 wherein, the curls comprise a plurality of curls in the hair; and each of the curls generally open towards the direction of the second opening.

7. The method of claim 1 wherein, the angle comprises a generally perpendicular angle;

the second opening comprises an opening to a device fin;

the device fin comprises one or more fin dimensions; and at least one of the one or more fin dimensions and the angle affect one or more curl features.

8. The method of claim 1 wherein, the hair comprises hair growing from a person's head;

positioning a first opening of a hair styling device comprising a first heating element and a second heating element in a generally vertical position comprises positioning the first opening of a hair styling device in a generally downward vertical position;

positioning a second opening of a hair styling device in a generally horizontal position comprises positioning the second opening of a hair styling device generally away from the person's head;

contacting the hair with the first heating element and the second heating element one of before and after the hair travelling through the second opening comprises contacting the hair with the first heating element and the second heating element after the hair travels through the second opening; and one of straightening and curling the hair comprises creating curls in the hair, wherein the curls open away from the person's head.

* * * * *